US006877463B2

(12) United States Patent
Moteki et al.

(10) Patent No.: US 6,877,463 B2
(45) Date of Patent: Apr. 12, 2005

(54) LINK MECHANISM OF RECIPROCATING INTERNAL COMBUSTION ENGINE

(75) Inventors: Katsuya Moteki, Tokyo (JP); Shunichi Aoyama, Kanagawa (JP); Kenshi Ushijima, Kanagawa (JP); Ryosuke Hiyoshi, Kanagawa (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 10/409,093

(22) Filed: Apr. 9, 2003

(65) Prior Publication Data

US 2003/0209213 A1 Nov. 13, 2003

(30) Foreign Application Priority Data

May 9, 2002 (JP) ..... 2002-133430

(51) Int. Cl.[7] ..... F02D 15/00
(52) U.S. Cl. ..... 123/48 B; 123/78 E; 123/78 F
(58) Field of Search ..... 123/48 B, 78 E, 123/78 F

(56) References Cited

U.S. PATENT DOCUMENTS 6,390,035 B2 * 5/2002 Moteki et al. ..... 123/78 BA
6,491,003 B2 * 12/2002 Moteki ..... 123/48 B
6,505,582 B2 * 1/2003 Moteki et al. ..... 123/48 B
6,510,821 B2 * 1/2003 Fujimoto et al. ..... 123/48 B
6,615,773 B2 * 9/2003 Moteki et al. ..... 123/48 B
6,622,670 B2 * 9/2003 Hiyoshi et al. ..... 123/48 B
6,684,828 B2 * 2/2004 Ushijima et al. ..... 123/48 B
2002/0002957 A1 1/2002 Moteki et al.

FOREIGN PATENT DOCUMENTS

| | | | |
|---|---|---|---|
| GB | 379169 | A | 8/1932 |
| JP | 9-228858 | A | 9/1997 |
| JP | 2002-21592 | A | 1/2002 |
| JP | 2002-54468 | A | 2/2002 |
| JP | 2002-70601 | A | 3/2002 |
| JP | 2002-115570 | A | 4/2002 |
| JP | 1 201 894 | A2 | 5/2002 |

* cited by examiner

*Primary Examiner*—Marguerite McMahon
(74) *Attorney, Agent, or Firm*—Foley & Lardner LLP

(57) ABSTRACT

A link mechanism of an engine includes: an upper link having a first end connected to a piston pin of a piston; a lower link connected to the upper link via an upper pin having a center, the lower link being connected to a crank pin of a crank shaft; a control shaft extending substantially in parallel with the crank shaft, the control shaft having a rotational center; and a control link including: a first end swingably connected to the control shaft, and a second end connected to the lower link. In a process of the center of the upper pin moving nearer to the axial line of the piston pin, the center of the control pin moves in the upward direction, thus inclining the lower link and allowing the center of the upper pin and the center of the piston pin to move in the downward direction.

16 Claims, 11 Drawing Sheets

LINK MECHANISM OF RECIPROCATING INTERNAL COMBUSTION ENGINE

BACKGROUND OF THE INVENTION

1. Field of the Invention

The present invention relates to a link mechanism of a reciprocating internal combustion engine.

2. Description of the Related Art

A conventional link mechanism of an internal combustion engine has a piston making a reciprocating motion which is transmitted to a crank shaft via a plurality of link members, thus rotating the crank shaft.

As is seen in FIG. 8 and FIG. 9, Japanese Patent Unexamined Publication No. Heisei 9 (1997)-228858 (=JP9228858) discloses the link mechanism of the internal combustion engine.

A lower link 42 is rotatably supported to a crank pin 41 of a crank shaft 40. Lower link 42 has a first end (left in FIG. 8) connected to a lower end of an upper link 44 via an upper pin 43. Lower link 42 has a second end (right in FIG. 8) connected to a lower end of a control link 46 via a control pin 45.

Upper link 44 has an upper end connected to a piston 48 via a piston pin 47. Control link 46 has an upper end connected to a control shaft 49 supported with a body of the internal combustion engine.

In the above construction, lower link 42 is swingably controlled (restricted) with control link 46 via control pin 45.

A predetermined line E' extends through a center C' of a crank main shaft 50 substantially in parallel with a direction along a reciprocating motion of piston 48. Moreover, an axial line G' (track G') of a center F' of piston pin 47 and a track I' of a center H' of upper pin 43 are tracked in accordance with the reciprocating motion of piston 48.

With respect to predetermined line E', control shaft 49 is disposed on a right side, as is seen in FIG. 8 and FIG. 9.

With respect to predetermined line E', axial line G'and track I'are disposed on a leftside, as is seen in FIG. 8. and FIG. 9.

A swingable center A' of control link 46 is disposed upper than center C' of crank main shaft 50 in the direction along the reciprocating motion of piston 48.

There is provided a track K' of a center J' of control pin 45. Track K' is movable in accordance with the reciprocating motion of piston 48. As is seen in FIG. 9, track K' is shaped substantially into an arc protruding downward in the direction substantially along the reciprocating motion of piston 48.

BRIEF SUMMARY OF THE INVENTION

The link mechanism of the reciprocating internal combustion engine according to the Japanese Patent Unexamined Publication No. Heisei 9 (1997)-228858 (=JP9228858), however, cause a maximum acceleration of piston 48 to an upward stroke in a period after piston 48's bottom dead center, the period making great an inclination $\phi$ of upper link 44 relative to the direction along the reciprocating motion of piston 48, as is seen in FIG. 11.

Hereinabove, the maximum acceleration of piston 48 may cause an inertial force of piston 48 in the direction along the reciprocating motion of piston 48.

At high engine speed causing the increased inertial force of piston 48 in the direction along axial line G'of piston 48, piston 48 may have an increase in thrust load which is applied in a direction substantially perpendicular to axial line G'. FIG. 10B shows variation in the angle of the crank shaft relative to the thrust load of the piston.

The above increase in the thrust load may cause frictional increase attributable to increase in sliding resistance of piston 48. Moreover, the above increase in the thrust load may cause deteriorated durability of a piston skirt 51.

It is an object of the present invention to provide a link mechanism of a reciprocating internal combustion engine.

It is another object of the present invention to prevent increase in piston's thrust load (which may be applied in a direction perpendicular to an axial line of a reciprocating motion of the piston) even when the piston's inertial force in a direction along the axial line of the reciprocating motion of the piston is increased at high engine speed.

It is still another object of the present invention to prevent frictional increase attributable to increase in sliding resistance of the piston and prevent deteriorated durability of a piston skirt.

According to a first aspect of the present invention, there is provided a link mechanism of a reciprocating internal combustion engine.

The link mechanism comprises:

1) an upper link having a first end connected to a piston pin of a piston, the piston pin having a center;

2) a lower link connected to the upper link via an upper pin having a center, the lower link being connected to a crank pin of a crank shaft;

3) a control shaft extending substantially in parallel with the crank shaft, the control shaft having a rotational center; and 4) a control link comprising:

i) a first end swingably connected to the control shaft, and ii) a second end connected to the lower link.

The control link has a swingable center for allowing the control link to swing with respect to the control shaft. The swingable center is offset from the rotational center of the control shaft. The control link is connected to the lower link via a control pin having a center.

A motion of the center of the upper pin in an upward direction substantially along a reciprocating motion of the piston moves the center of the piston pin in the upward direction, while the motion of the center of the upper pin in a downward direction substantially along the reciprocating motion of the piston moves the center of the piston pin in the downward direction.

The reciprocating motion of the piston makes an axial line which is a first track of the center of the piston pin, and the center of the upper pin moving nearer to the axial line moves the center of the piston pin in the upward direction while the center of the upper pin moving away from the axial line moves the center of the piston pin in the downward direction.

In a process of the center of the upper pin moving nearer to the axial line of the piston pin, the center of the control pin moves in the upward direction, thus inclining the lower link and allowing the center of the upper pin and the center of the piston pin to move in the downward direction.

According to a second aspect of the present invention, there is provided a link mechanism of a reciprocating internal combustion engine.

The link mechanism comprises:

1) an upper link having a first end connected to a piston pin of a piston, the piston pin having a center;

2) a lower link connected to the upper link via an upper pin having a center;

3) a crank shaft comprising:

i) a crank pin connected to the lower link, the crank pin having a center, and ii) a crank main journal having a center through which a predetermined line extends substantially in parallel with a direction along a reciprocating motion of the piston;

4) a control shaft extending substantially in parallel with the crank shaft, with respect to the predetermined line the control shaft being disposed on a first side where the center of the crank pin moves downward, the control shaft having a rotational center; and 5) a control link comprising:

i) a first end swingably connected to the control shaft, and ii) a second end connected to the lower link.

The control link has a swingable center for allowing the control link to swing with respect to the control shaft. The swingable center is offset from the rotational center of the control shaft. The control link is connected to the lower link via a control pin having a center.

The reciprocating motion of the piston makes an axial line which is a first track of the center of the piston pin while the center of the upper pin makes a second track. With respect to the predetermined line, the axial line and the second track are disposed on a second side where the center of the crank pin moves upward.

The swingable center of the control link is disposed lower than the center of the crank main journal in the direction along the reciprocating motion of the piston.

The center of the control pin makes a third track which is movable in accordance with the reciprocating motion of the piston. The third track is shaped substantially into an arc protruding substantially upward in the direction of the reciprocating motion of the piston.

The other objects and features of the present invention will become understood from the following description with reference to the accompanying drawings.

BRIEF DESCRIPTION OF THE SEVERAL VIEWS OF THE DRAWINGS

FIG. 7A shows an outer peripheral radius R indicated by a longer arrow, and 2.

DETAILED DESCRIPTION OF THE EMBODIMENT

In the following, various embodiments of the present invention will be described in detail with reference to the accompanying drawings.

For ease of understanding, the following description will contain various directional terms, such as, left, right, upward, downward, and the like. However, such terms are to be understood with respect to only a drawing or drawings on which the corresponding part of element is illustrated.

Figure 1:
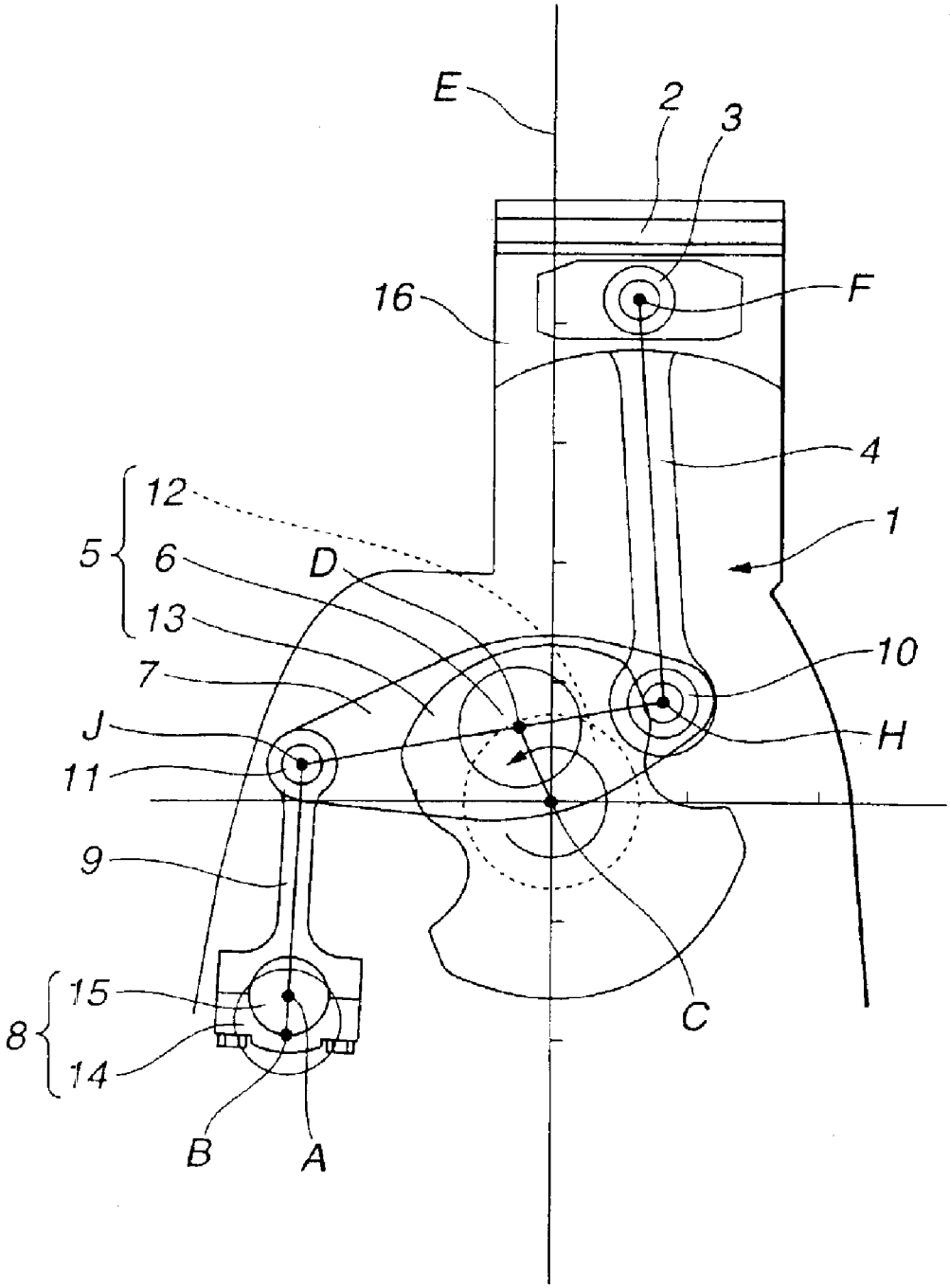
FIG. 1 is an explanatory view of a link mechanism 1 of a reciprocating internal combustion engine, according to a first embodiment of the present invention.
Figure 2:
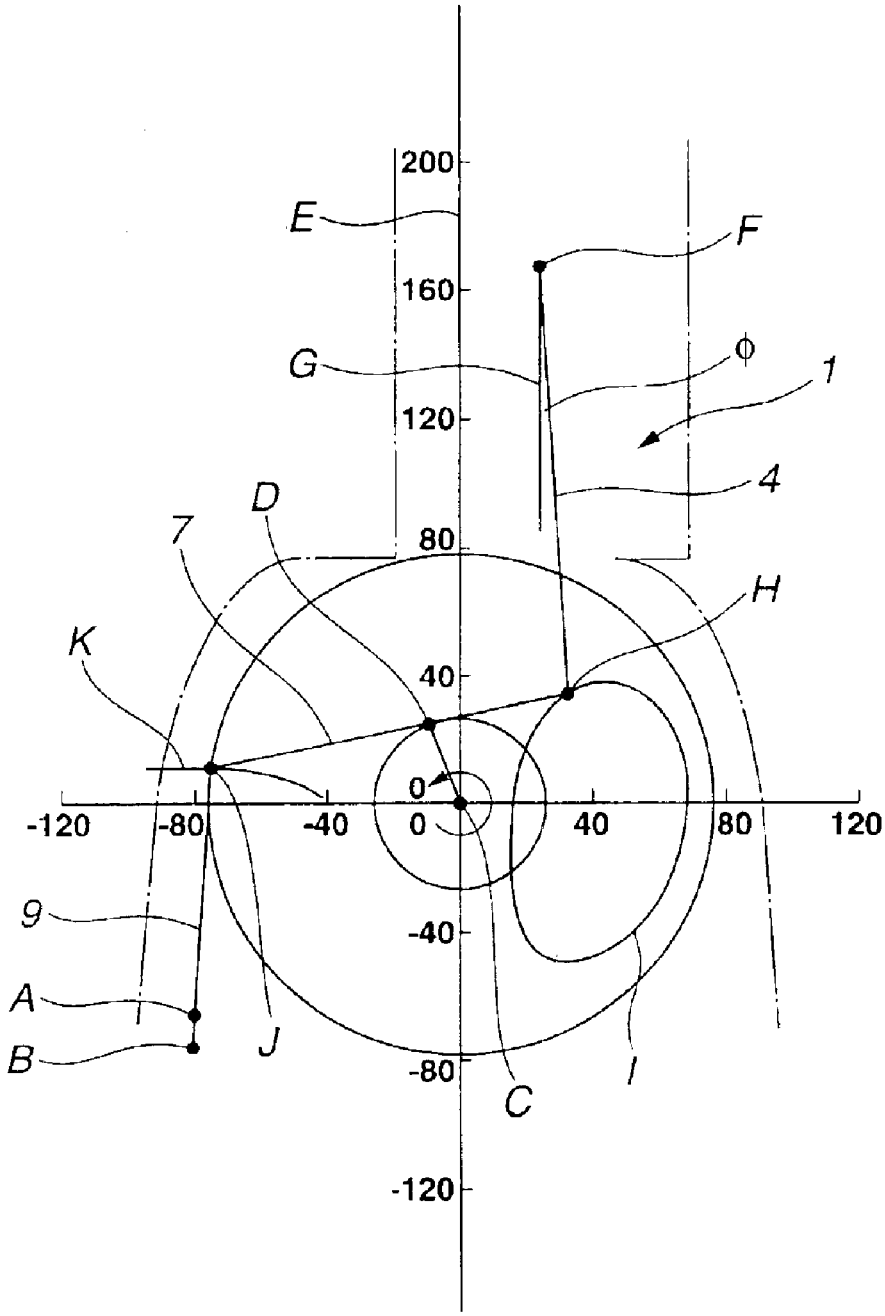
FIG. 2 is a schematic of link mechanism 1 in FIG. 1, showing a state in which a piston 2 is in the vicinity of its top dead center (TDC), according to the first embodiment.

As is seen in FIG. 1 and FIG. 2, there is provided a link mechanism 1 of a reciprocating internal combustion engine, according to a first embodiment of the present invention.

Link mechanism 1 includes an upper link 4, a lower link 7, a control shaft 8 and a control link 9.

Upper link 4 has a first end (upper in FIG. 1) connected to a piston pin 3 of a piston 2. Lower link 7 is connected to upper link 4, and to a crank pin 6 of a crank shaft 5. Control shaft 8 extends substantially in parallel with crank shaft 5. Control link 9 has a first end (lower in FIG. 1) swingably connected to control shaft 8, and a second end (upper in FIG. 1) connected to lower link 7. Control link 9 has a swingable center A which is offset from a rotational center B of control shaft 8. With respect to control shaft 8, control link 9 swings around swingable center A.

Upper link 4 and lower link 7 are connected to each other via an upper pin 10 in such a manner as to rotate relative to each other. Lower link 7 and control link 9 are connected to each other via a control pin 11 in such a manner as to rotate relative to each other.

Crank shaft 5 includes a crank main journal 12, crank pin 6 and a crank counter weight 13. Crank pin 6 has a center D which is offset from a center C of crank main journal 12.

Control shaft 8 includes a control main shaft 14 and an offset shaft 15. Control main shaft 14 is rotatably controlled with a driving device (not shown in FIG. 1 and FIG. 2). Offset shaft 15 has a center (swingable center A) which is offset from control main shaft 14. Control link 9 has the first end (lower in FIG. 1) which is so connected to offset shaft 15 in such a manner as to rotate with respect to offset shaft 15.

Link mechanism 1 having the above construction defines a predetermined line E extending through center C of crank main journal 12 substantially in parallel with direction along a reciprocating motion of piston 2.

On a first side (left in FIG. 1 and FIG. 2) of predetermined line E, control shaft 8 is disposed.

On a second side (right in FIG. 1 and FIG. 2) of predetermined line E, there are provided an axial line G (see FIG. 2) of the reciprocating motion of piston 2 (or piston pin 3), and a second track I (see FIG. 2) of a center H of upper pin 10. Axial line G is a first track G for tracking a center F of piston pin 3, in accordance with the reciprocating motion of piston 2. Second track I tracks center H of upper pin 10, in accordance with the reciprocating motion of piston 2.

In other words, described as below:

Predetermined line E extends through center C of crank main journal 12 substantially in parallel with the direction along the reciprocating motion of piston 2.

With respect to predetermined line E, control shaft 8 is disposed on the first side (left in FIG. 1 and FIG. 2 ) where center D of crank pin 6 moves downward.

With respect to predetermined line E, axial line G (see FIG. 2 ) and second track (see FIG. 2 ) are disposed on the second side (right in FIG. 1 and FIG. 2 ) where center D of crank pin 6 moves upward.

Moreover, swingable center A of control link 9 is disposed lower than center C of crank main journal 12 in the direction along the reciprocating motion of piston 2.

As is seen in FIG. 2, there is provided a third track K of a center J of control pin 11. Third track K is movable in accordance with the reciprocating motion of piston 2. Third track K is shaped substantially into an arc protruding upward in the direction substantially along the reciprocating motion of piston 2.

The driving device (not shown in FIG. 1 and FIG. 2) rotating control main shaft 14 of control shaft 8 relative to a body of the internal combustion engine can vary compression ratio of the internal combustion engine. In other words, varying the compression ratio means varying position of piston 2 at its top dead center (hereinafter referred to as "TDC" for short).

With piston 2 at its TDC, center H of upper pin 10 is disposed on a lagging side of a rotation of crank shaft 5, with respect to a line D–F (not depicted in FIG. 1 and FIG. 2) connecting center D of crank pin 6 to center F of piston pin 3. In other words, with piston 2 at its TDC, center H of upper pin 10 is disposed on the right side in FIG. 1, with respect to the line D–F (not depicted in FIG. 1 and FIG. 2).

As is seen in FIG. 1, there is provided a piston skirt 16 of piston 2. In link mechanism 1 according to the first embodiment, center H of upper pin 10 is disposed on a line D–J connecting center D of crank pin 6 to center J of control pin 11.

Link mechanism 1 having the above construction according to the first embodiment can cause a maximum acceleration of piston 2 (see FIG. 3A) to a downward stroke of piston 2 in a first period before piston 2's bottom dead center (hereinafter referred to as "BDC" for short), the first period making small an inclination $\phi$ of upper link 4 relative to the direction along the reciprocating motion of piston 2.

Hereinabove, the maximum acceleration of piston 2 may cause an inertial force of piston 2 in the direction along the reciprocating motion of piston 2.

Figure 4:
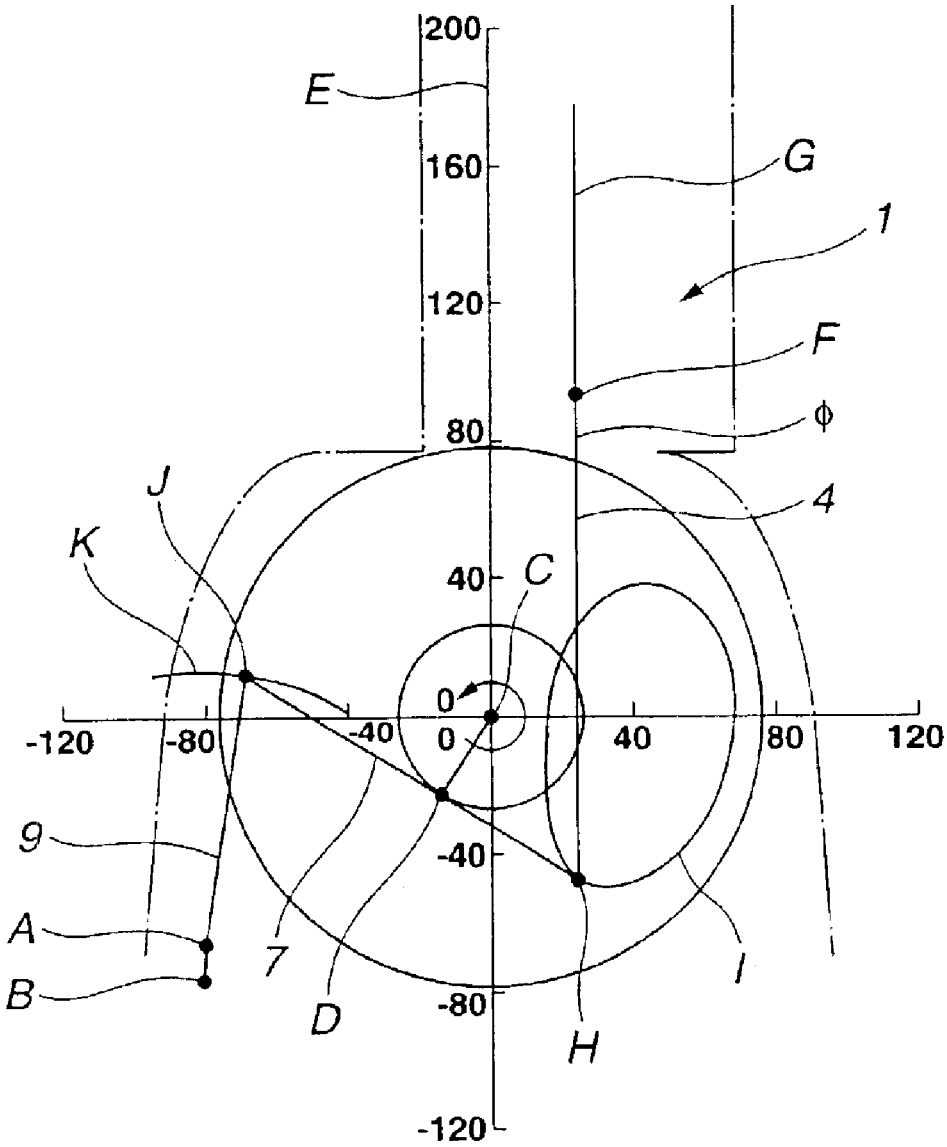
FIG. 4 is a schematic of link mechanism 1 in FIG. 1, showing a state (first period) in which piston 2 is in the vicinity of (on the eve of) its bottom dead center (BDC), according to the first embodiment.

FIG. 4 shows a schematic of link mechanism 1 with piston 2 in the first period before (on the eve of) its BDC, causing small inclination $\phi$ of upper link 4. Being as small as 0 ($\approx$0), inclination $\phi$ is not obviously shown in FIG. 4. Location of inclination $\phi$ can be seen otherwise in FIG. 2.

Even at high engine speed causing the increased inertial force of piston 2 in the direction along axial line G of piston 2, piston 2 can be prevented from an increase in thrust load which may be applied in a direction substantially perpendicular to axial line G. FIG. 2. 3B shows variation in the angle of the crank shaft 5 relative to the thrust load of the piston 2.

The above prevention from the increase in the thrust load can prevent frictional increase attributable to increase in sliding resistance of piston 2. Moreover, the above prevention from the increase in the thrust load can prevent deteriorated durability of piston skirt 16.

Moreover, link mechanism 1 according to the first embodiment can prevent the deteriorated durability of piston skirt 16 in a second period before and after the TDC of piston 2, for the following cause:

Cause: The second period has upper link 4 that is sufficiently free from being in accordance with the direction along axial line G. of piston pin 3. In other words, the thrust load is likely to occur to piston 2 in the second period. An absolute value of piston 2's downward acceleration in FIG. 3A in the second period is smaller than its counterpart in FIG. 10A according to the related art.

The above cause can be accounted for with the following point 1 and point 2:

Point 1 Motion of center H of upper pin 10 can determine motion of piston pin 3.

Point 2 The motion of piston 3 synthesizes two motion factors of center H of upper pin 10.

One of the two motion factors of center H of upper pin 10 is in the direction substantially along the reciprocating motion of center H of upper pin 10. More specifically, center H of upper pin 10 moving upward in the direction substantially along the reciprocating motion of piston 2 can move center F of piston pin 3 upward, while center H of upper pin 10 moving downward in the direction substantially along the reciprocating motion of piston 2 can move center F of piston pin 3 downward.

The other of the two motion factors of center H of upper pin 10 is substantially perpendicular to the direction along the reciprocating motion of center H of upper pin 10. More specifically, center H of upper pin 10 moving nearer to axial line G of piston 3 moves center F of piston pin 3 upward in the direction along the reciprocating motion of piston 2, while center H of upper pin 10 moving away from axial line G of piston 3 moves center F of piston pin 3 downward in the direction along the reciprocating motion of piston 2.

Figure 8:
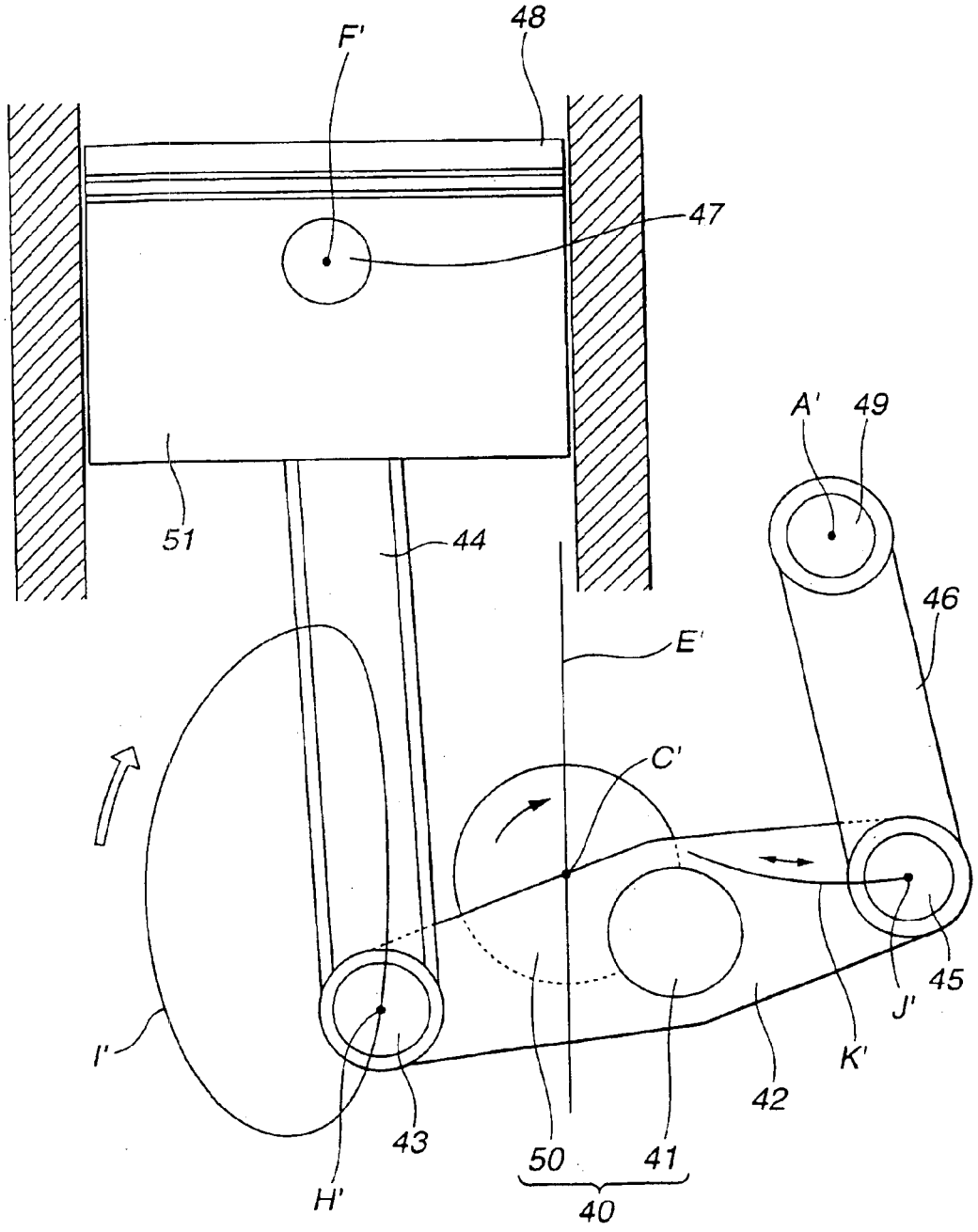
FIG. 8 PRIOR ART
FIG. 8 shows a link mechanism, according to a related art.
Figure 9:
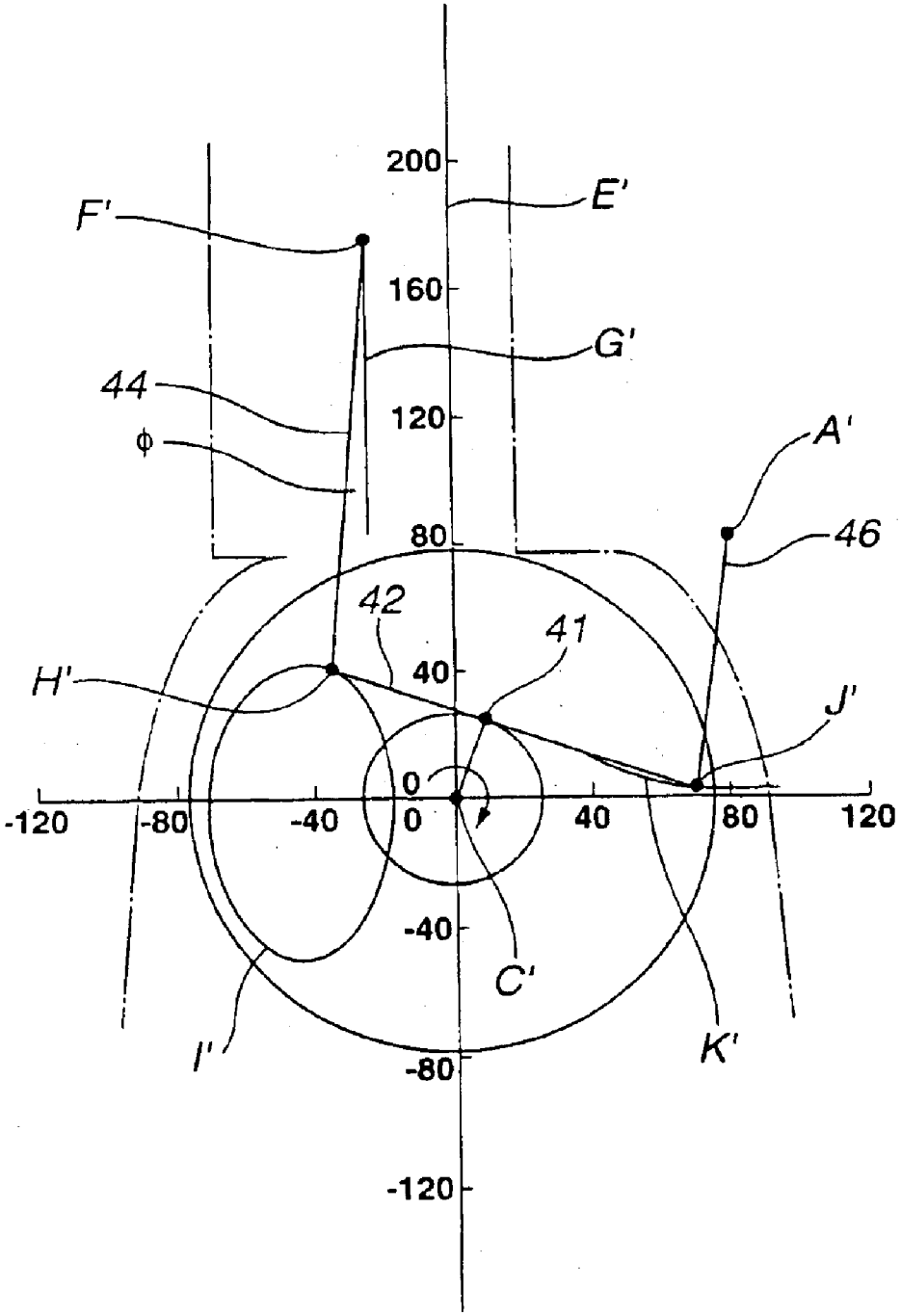
FIG. 9 PRIOR ART
FIG. 9 is a schematic of the link mechanism, showing a state in which a piston is in the vicinity of its top dead center (TDC), according to the related art.

According to the Japanese Patent Unexamined Publication No. Heisei 9 (1997)-228858 (=JP9228858) with track K' of center J' of control pin 45 protruding downward as is seen in FIG. 9, center H' of upper pin 43 moving nearer to axial line G' of piston pin 47 (in other words, in a process of moving piston pin 47 upward) can move center J' of control pin 45 downward. With this, lower link 42 can rotate counterclockwise around crank pin 41, as is seen in FIG. 8 and FIG. 9, to thereby move center H' of upper pin 43 and center F' of piston pin 47 upward in the direction substantially along the reciprocating motion of piston 48.

Figure 10A:
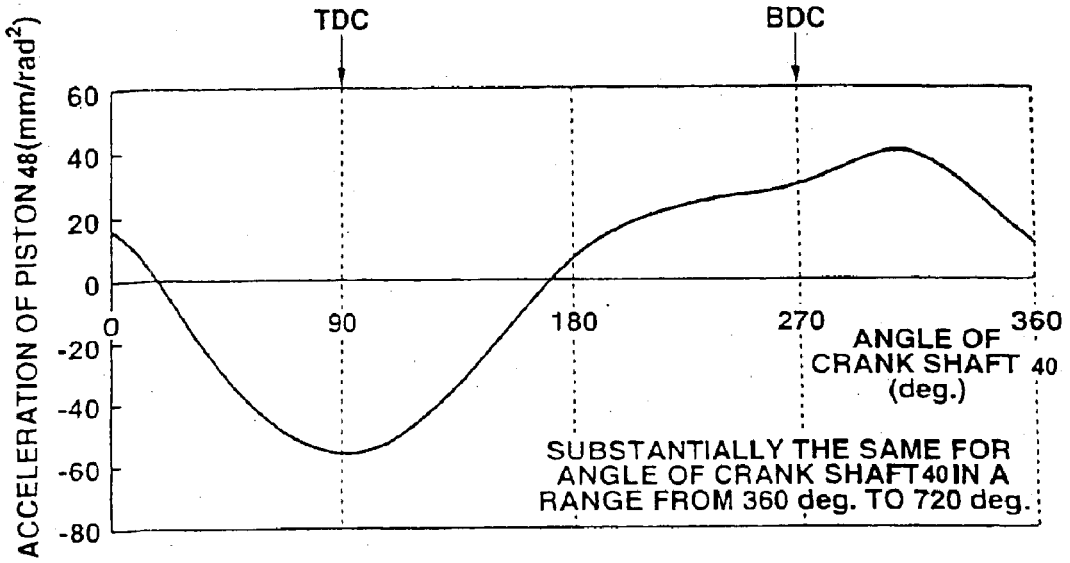
FIG. 10A PRIOR ART
FIG. 10 has an upper graph (FIG. 10A) showing variation in angle of a crank shaft relative to an acceleration of the piston, and a lower graph (FIG. 10B) showing variation in the angle of the crank shaft relative to a thrust load ratio of the piston, according to the related art.
Figure 10B:
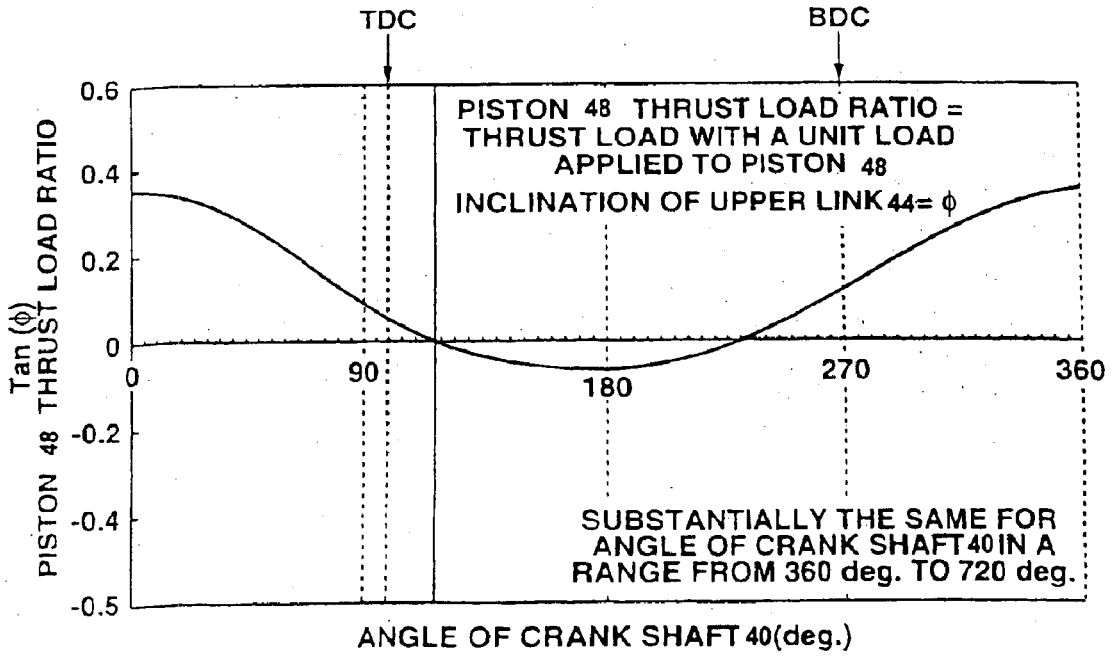
FIG. 10B PRIOR ART
Figure 11:
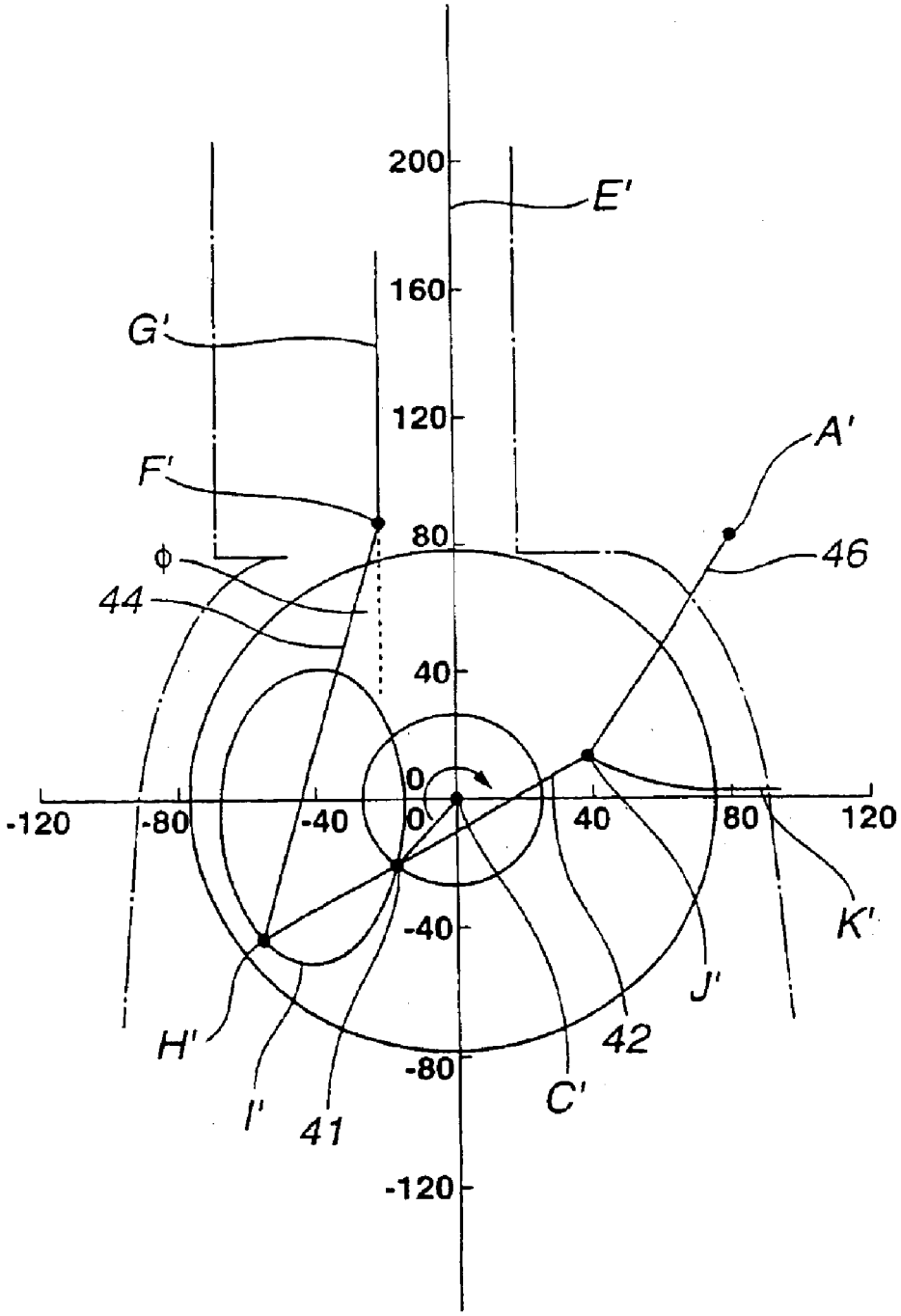
FIG. 11 PRIOR ART
FIG. 11 is a schematic of the link mechanism in FIG. 8, showing a state in which the piston is in the vicinity of its bottom dead center (BDC), according to the related art.

In sum, an effect of moving piston pin 47 upward is thus encouraged, resulting in an increased acceleration of piston 48 in the vicinity of the TDC, as is seen in FIG. 10A. The thus increased acceleration may increase the inertia force of piston 48 at high engine speed, to thereby cause the excessive load to a bearing (not shown) of crank pin 41 and deteriorate the durability of the bearing (not shown) of crank pin 41.

On the other hand, according to the first embodiment of the present invention with third track K of center J of control pin 11 protruding upward as is seen in FIG. 2, center H of upper pin 10 moving nearer to axial line G of piston pin 3 (in other words, in the process of moving piston pin 3 upward) can move center J of control pin 11 upward. With this, lower link 7 can rotate clockwise around crank pin 6, as is seen in FIG. 1 and FIG. 2, to thereby move center H of upper pin 10 and center F of piston pin 3 downward in the direction substantially along the reciprocating motion of piston 2.

Figure 3A:
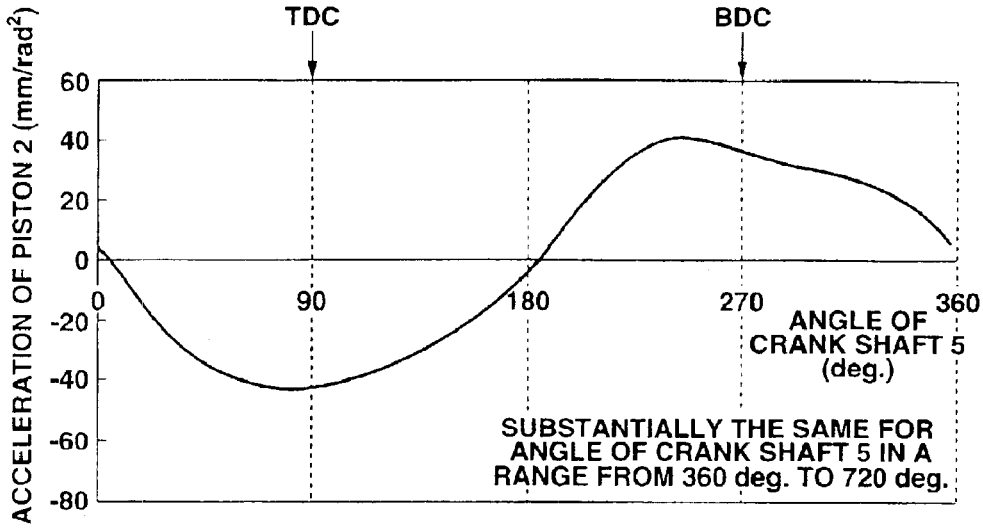
FIG. 3 has an upper graph (FIG. 3A) showing variation in angle of a crank shaft 5 relative to an acceleration of piston 2, and a lower graph (FIG. 3B) showing variation in the angle of crank shaft 5 relative to a thrust load ratio of piston 2, according to the first embodiment.
Figure 3B:
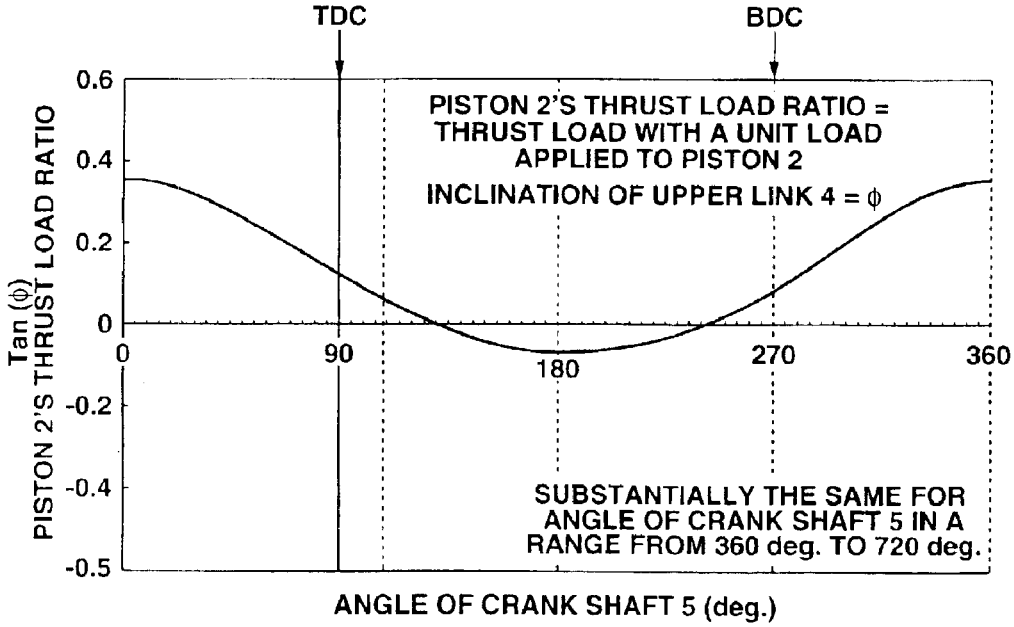

Thereby, a behavior of center H of upper pin 10 moving nearer to axial line G so as to move piston pin 3 upward can be "counteracted" by the clockwise rotation of lower link 7, resulting in the controlled (restricted) acceleration of piston 2 at its TDC, as is seen in FIG. 3A. The thus controlled (restricted) acceleration can control the inertial force of piston 2 at high engine speed, to thereby control (restrict) the load applied to the bearing (not shown) of crank pin 6 and maintain the durability of the bearing (not shown) of crank pin 6.

Moreover according to the first embodiment of the present invention, the above "counteraction" by the clockwise rotation of lower link 7 can reduce, to a great extent, a secondary vibration of crank shaft 5. Hereinabove, the secondary vibration may uncomfortably be caused to the body of the reciprocating internal combustion engine of in-line four-cylinder type. In other words, making piston 2's stroke into substantially a simple harmonic oscillation for the rotation of crank shaft 5 can reduce, to a great extent, the secondary vibration of crank shaft 5 which may be caused to the body of the internal combustion engine.

Figure 5:
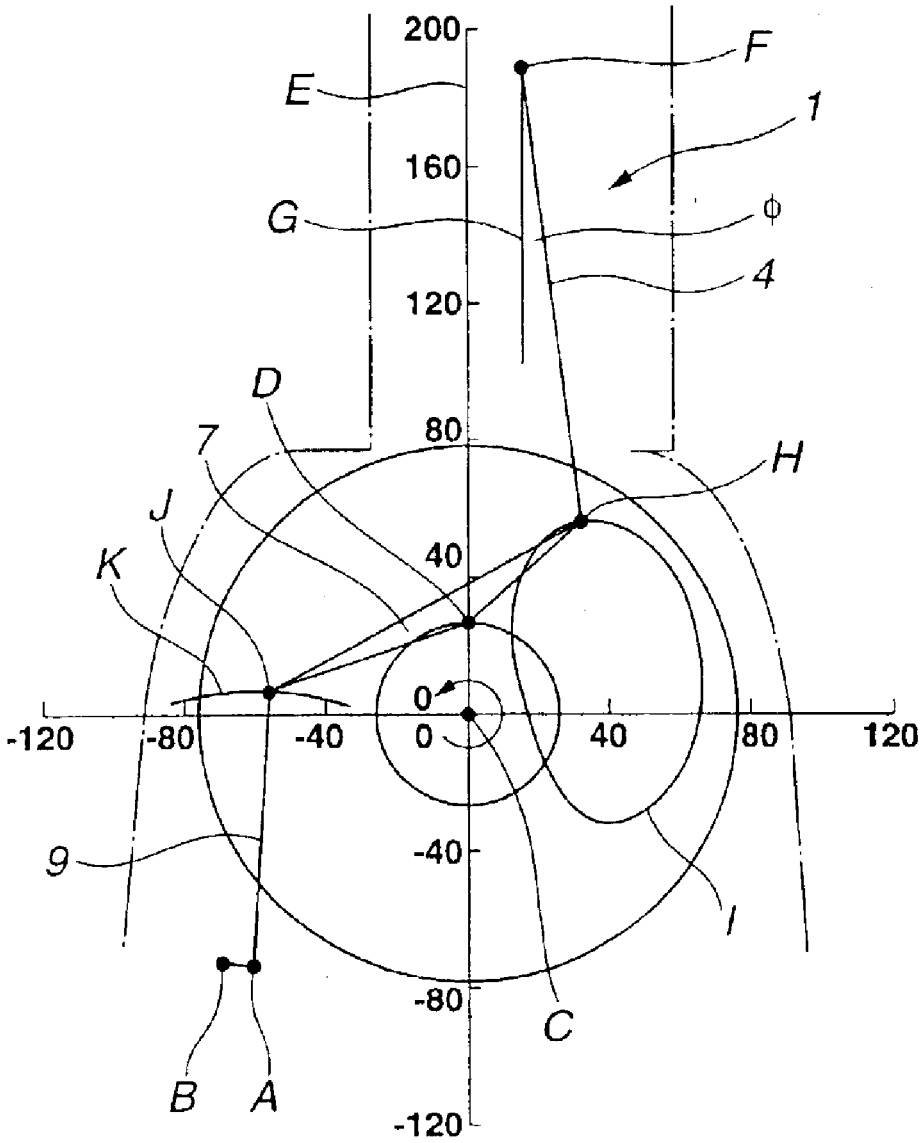
FIG. 5 is a schematic of link mechanism 1, showing a state in which piston 2 is in the vicinity of its top dead center (TDC), according to a second embodiment of the present invention.
Figure 6:
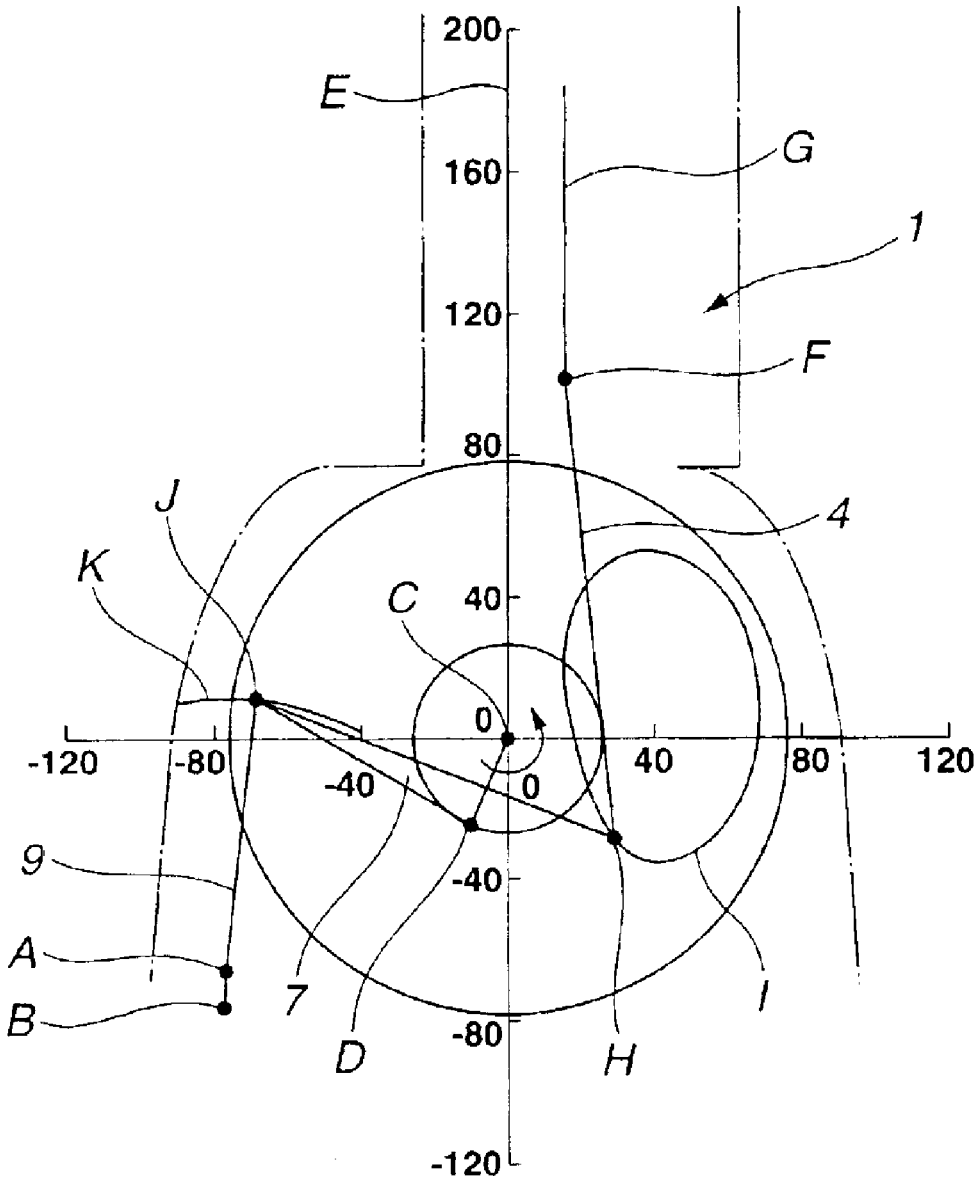
FIG. 6 is a schematic of link mechanism 1, showing a state in which piston 2 is in the vicinity of its bottom dead center (BDC), according to the second embodiment.

FIG. 5 and FIG. 6 show schematics of link mechanism 1 of the internal combustion engine, according to a second embodiment of the present invention.

FIG. 5 shows a state in which piston 2 is in the vicinity of its TDC, while FIG. 6 shows a state in which piston 2 is in the vicinity of its BDC.

Link mechanism 1 according to the second embodiment is substantially similar to link mechanism 1 according to the first embodiment. Link mechanism 1 according to the second embodiment is, however, different from link mechanism 1 according to the first embodiment in the following point:

As described above, link mechanism 1 according to the first embodiment has center H of upper pin 10 on line D–J, as is seen in FIG. 1 and FIG. 2.

Contrary to link mechanism 1 according to the first embodiment, center H of upper pin 10 according to the second embodiment is deflected toward piston pin 3's side. In other words, center H of upper pin 10 according to the second embodiment is deflected toward piston 2, with respect to line D–J.

Thereby, center D of crank pin 6 in FIG. 6 according to the second embodiment has a shortest distance (to upper link 4) that is longer than a shortest distance (to upper link 4) in FIG. 4 according to the first embodiment.

With the longer shortest distance (to upper link 4) compared with the first embodiment, link mechanism 1 according to the second embodiment can have a greater diameter of crank pin 6 and a greater cross section of upper link 4, thus improving crank shaft 5 and upper link 4 in strength and rigidity.

Figure 7A:
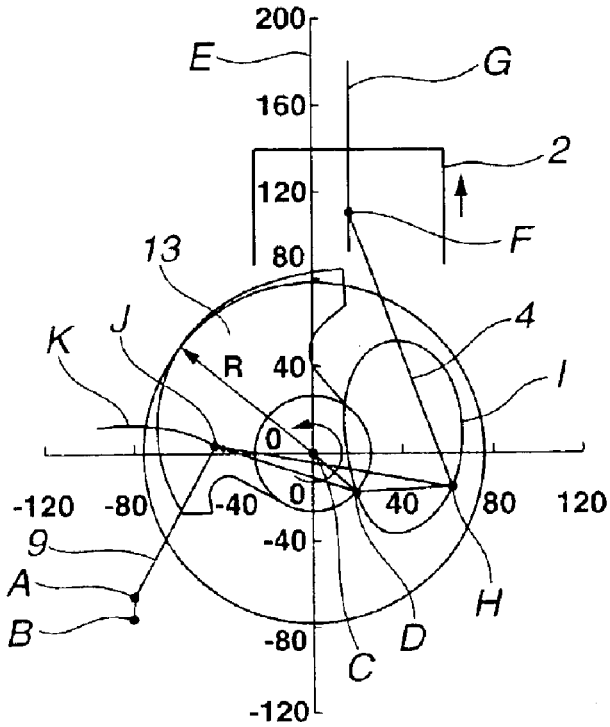
FIG. 7A are a schematic of link mechanism 1, showing a state in which piston 2 is in the vicinity of its bottom dead center (BDC), according to a third embodiment of the present invention, in which 1.
Figure 7B:
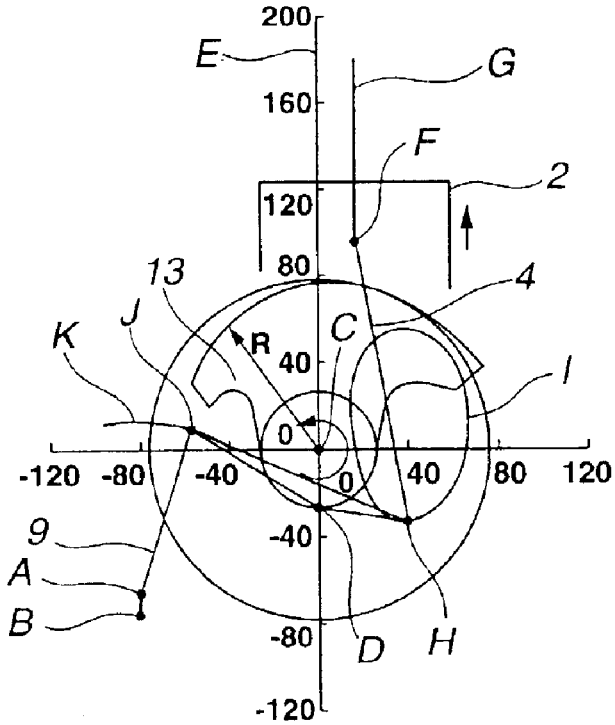
FIG. 7B shows the outer peripheral radius R indicated by a shorter arrow.

FIGS. 7A and 7B show a schematic of link mechanism 1 of the internal combustion engine, according to a third embodiment of the present invention.

FIGS. 7A and 7B show a state in which piston 2 is in the vicinity of its Link mechanism 1 according to the third embodiment is substantially similar to link mechanism 1 according to the first embodiment. Link mechanism 1 according to the third embodiment is, however, different from link mechanism 1 according to the first embodiment in the following points:

As described above, link mechanism 1 according to the first embodiment has center H of upper pin 10 on line D–J, as is seen in FIG. 1 and FIG. 2.

Contrary to link mechanism 1 according to the first embodiment, center H of upper pin 10 according to the third embodiment is deflected toward piston pin 3's side. In other words, center H of upper pin 10 according to the third embodiment is deflected toward piston 2, with respect to line D–J.

Moreover, crank counter weight 13 of crank shaft 5 has an outer peripheral radius R extending from center C of crank main journal 12. Outer peripheral radius R is so formed as to become greater toward the lagging side of the rotation of crank shaft 5. In other words, being indicated for comparison by a longer arrow in FIG. 7A and a shorter arrow in FIG. 7B, outer peripheral radius R of crank counter weight 13 is so formed as to become smaller in a direction of forward rotation of crank main journal 12.

Piston skirt 16 on an advanced side of the rotation of crank shaft 5 is presumed to have substantially a shortest distance to crank counter weight 13. With the construction of link mechanism 1 according to the third embodiment, however, the interference (between crank counter weight 13 and piston skirt 16 when crank shaft 5 is on its advanced side of the rotation) can be prevented and crank shaft 5 can have a great moment of inertia (rotation).

In sum according to the third embodiment, crank shaft 5 can attain a balance with ease, and collision (resistance) between lubricant splash (spray, drop and the like) and crank counter weight 13 in a crank case can be reduced.

Although the present invention has been described above by reference to certain embodiments, the present invention is not limited to the embodiments described above. Modifications and variations of the embodiments described above will occur to those skilled in the art, in light of the above teachings.

More specifically, link mechanism 1 according to the first embodiment, the second embodiment and the third embodiment of the present invention is applicable to an internal combustion engine incorporating a super charger.

This application is based on a prior Japanese Patent Application No. P2002-133430 (filed on May 9, 2002 in Japan). The entire contents of the Japanese Patent Application No. P2002-133430 from which priority is claimed is incorporated herein by reference, in order to take some protection against mis-translation or omitted portions.

The scope of the present invention is defined with reference to the following claims.

What is claimed is:

1. A link mechanism of a reciprocating internal combustion engine, comprising:

an upper link connected to a piston pin of a piston;

a lower link connected to the upper link via an upper pin and connected to a crank pin of a crank shaft; and a control link including a first end connected to a control shaft, and a second end connected by a control pin to the lower link, wherein a center of the control pin is configured to move in an upward reciprocating direction of the piston when a center of the upper pin moves nearer to an axial line defined by travel of a center of the piston pin during a reciprocating motion of the piston, thus inclining the lower link to thereby counteract an upward motion of the center of the upper pin and the center of the piston pin.

2. The link mechanism of the reciprocating internal combustion engine as claimed in claim 1, wherein with the piston at a top dead center thereof, the center of the upper pin is disposed on a lagging side of a rotation of the crank shaft, with respect to a line connecting a center of the crank pin to the center of the piston pin.

3. The link mechanism of the reciprocating internal combustion engine as claimed in claim 1, wherein the piston makes a stroke of substantially a simple harmonic oscillation for a rotation of the crank shaft.

4. The link mechanism of the reciprocating internal combustion engine as claimed in claim 1, wherein the center of the upper pin is disposed in an area including the piston pin, with respect to a line connecting the center of the crank pin to the center of the control pin.

5. The link mechanism of the reciprocating internal combustion engine as claimed in claim 1, wherein the crank shaft further comprises a crank counter weight having an outer peripheral radius which is so formed as to become greater toward a lagging side of a rotation of the crank shaft.

6. The link mechanism of the reciprocating internal combustion engine as claimed in claim 1, wherein rotating the control shaft relative to a body of the reciprocating internal combustion engine varies a top dead center of the piston.

7. The link mechanism of the reciprocating internal combustion engine as claimed in claim 1, wherein the reciprocating internal combustion engine includes a super charger.

8. A link mechanism of a reciprocating internal combustion engine, comprising:

an upper link connected to a piston pin of a piston;

a lower link connected to the upper link via an upper pin;

a crank shaft including
a crank pin connected to the lower link and
a crank main journal;

a control shaft extending substantially in parallel with the crank shaft; and a control link including
a first end swingably connected to the control shaft,
a second end connected by a control pin to the lower link, and a swingable center which is offset from a rotational center of the control shaft for allowing the control link to swing with respect to the control shaft and which is disposed lower than a center of the crank main journal in the direction along the reciprocating motion of the piston, wherein the crank main journal has a center through which a predetermined line extends substantially in parallel with a direction along a reciprocating motion of the piston, and wherein a reciprocating motion of the piston makes an axial line which is a first track of a center of the piston pin while a center of the upper pin makes a second track, wherein the control shaft is disposed on a first side of the predetermined line where a center of the crank pin moves downward, and the first and second tracks are disposed on a second side of the predetermined line where the center of the crank pin moves upward, and wherein a center of the control pin makes a third track which is movable in accordance with the reciprocating motion of the piston, the third track being shaped substantially into an arc protruding substantially in an upward direction of the reciprocating motion of the piston.

9. The link mechanism of the reciprocating internal combustion engine as claimed in claim 8, wherein with the piston at a top dead center thereof, the center of the upper pin is disposed on a lagging side of a rotation of the crank shaft, with respect to a line connecting a center of the crank pin to the center of the piston pin.

10. The link mechanism of the reciprocating internal combustion engine as claimed in claim 8, wherein the piston makes a stroke of substantially a simple harmonic oscillation for a rotation of the crank shaft.

11. The link mechanism of the reciprocating internal combustion engine as claimed in claim 8, wherein the center of the upper pin is disposed in an area including the piston pin, with respect to a line connecting the center of the crank pin to the center of the control pin.

12. The link mechanism of the reciprocating internal combustion engine as claimed in claim 8, wherein the crank shaft further comprises a crank counter weight having an outer peripheral radius which is so formed as to become greater toward a lagging side of a rotation of the crank shaft.

13. The link mechanism of the reciprocating internal combustion engine as claimed in claim 8, wherein rotating the control shaft relative to a body of the reciprocating internal combustion engine varies a top dead center of the piston.

14. The link mechanism of the reciprocating internal combustion engine as claimed in claim 8, wherein the reciprocating internal combustion engine includes a super charger.

15. The link mechanism of the reciprocating internal combustion engine as claimed in claim 1, wherein an end of the lower link connected to the control pin is configured to incline toward the axial line to thereby counteract the upward motion of the center of the upper pin and the center of the piston pin.

16. The link mechanism of the reciprocating internal combustion engine as claimed in claim 1, wherein the upward motion of the center of the upper pin and the center of the piston pin is counteracted when the piston is in a vicinity of top dead center.

* * * * *